United States Patent [19]

Ikemoto et al.

[11] 4,431,297

[45] Feb. 14, 1984

[54] COPYING MACHINE FOR ELECTROPHOTOGRAPHY

[75] Inventors: Isao Ikemoto; Akihiko Tamura, both of Hachioji, Japan

[73] Assignee: Konishiroku Photo Industry Co., Ltd., Tokyo, Japan

[21] Appl. No.: 326,263

[22] Filed: Dec. 1, 1981

[30] Foreign Application Priority Data

Dec. 17, 1980 [JP] Japan ..... 55-180155[U]

[51] Int. Cl.[3] ..... G03G 15/08

[52] U.S. Cl. ..... 355/3 DD; 355/3 R; 355/14 D; 118/651

[58] Field of Search ..... 355/3 DD, 14 D, 3 R; 118/651, 652, 653, 636, 657

[56] References Cited

U.S. PATENT DOCUMENTS

| | | | |
|---|---|---|---|
| 3,480,359 | 11/1969 | Lawes et al. | 355/3 R |
| 3,809,012 | 5/1974 | Delvecchio | 118/636 X |
| 4,271,786 | 6/1981 | Buckley et al. | 355/3 DD |

*Primary Examiner*—A. C. Prescott

*Attorney, Agent, or Firm*—Jordan B. Bierman; Linda Bierman

[57] ABSTRACT

In an electrophotographic copying machine in which a developing device is disposed adjacent a photosensitive drum for distributing particulate developer over the rotating drum surface to develop an electrostatic image thereon, a sealing member of an elastic material is provided between each end wall of the drum lying substantially perpendicular to the drum surface and an adjacent side wall of the developing device to prevent leakage of developer particles about the drum.

6 Claims, 2 Drawing Figures

COPYING MACHINE FOR ELECTROPHOTOGRAPHY

BACKGROUND OF THE INVENTION

1. Field of the Invention

The present invention relates to a copying machine for an electrophotography, and particularly relate to the improvement of the sealing structure for the photosensitive drum of the developing device and the cleaning device (hereinafter referred to as the developing device etc.) in the electrophotographic recording apparatus wherein the photosensitive drum is used.

2. Description of the Prior Art

In the conventional copying machine for an electrophotography, it has been tried that the side walls of the developing device etc. are kept close to the circumferential surface of the photosensitive drum as far as possible in order to prevent the developer to scatter out from the clearance where the side walls of the developing device etc. contact the circumferential surface of the photosensitive drum and when such arrangement does not prevent the scattering fully, sealing members made of elastic material such as foamed rubber or felt are arranged so that they contact the circumferential surface of the photosensitive drum to fill the clearance. With an arrangement of such sealing member, the scattering of the developer can be prevented but the photosensitive substance on the circumferential surface of the photosensitive drum to which the sealing member contacts tends to be scratched and the distance between the photosensitive drum and the developing device etc. becomes unstable when the sealing member is firmly compressed for the perfect sealing effect and especially in the part where the high stability is required such as the clearance between the developing sleeve and the photosensitive drum in the magnetic brush of the developing device, problems tend to happen. In order to prevent the photosensitive substance to be easily damaged, on the other hand, if the portions without the photosensitive substance and with a sufficient width are arranged on the both sides of the photosensitive drum, the photosensitive drum has to become larger by the size corresponding to such portions.

SUMMARY OF THE INVENTION

The present invention is to offer a copying machine for an electrophotography that does not have aforesaid problems and it is a copying machine for an electrophotography, which comprises, a photosensitive drum, a developing device comprising side walls of said developing device, and a sealing member made of an elastic material being equipped between said side walls and the end face on the side of said photosensitive drum for filling the clearance between the both items.

The present invention will be explained as follows referring to the drawings.

DETAILED DESCRIPTION OF THE PREFERRED EMBODIMENTS

Figure 1:
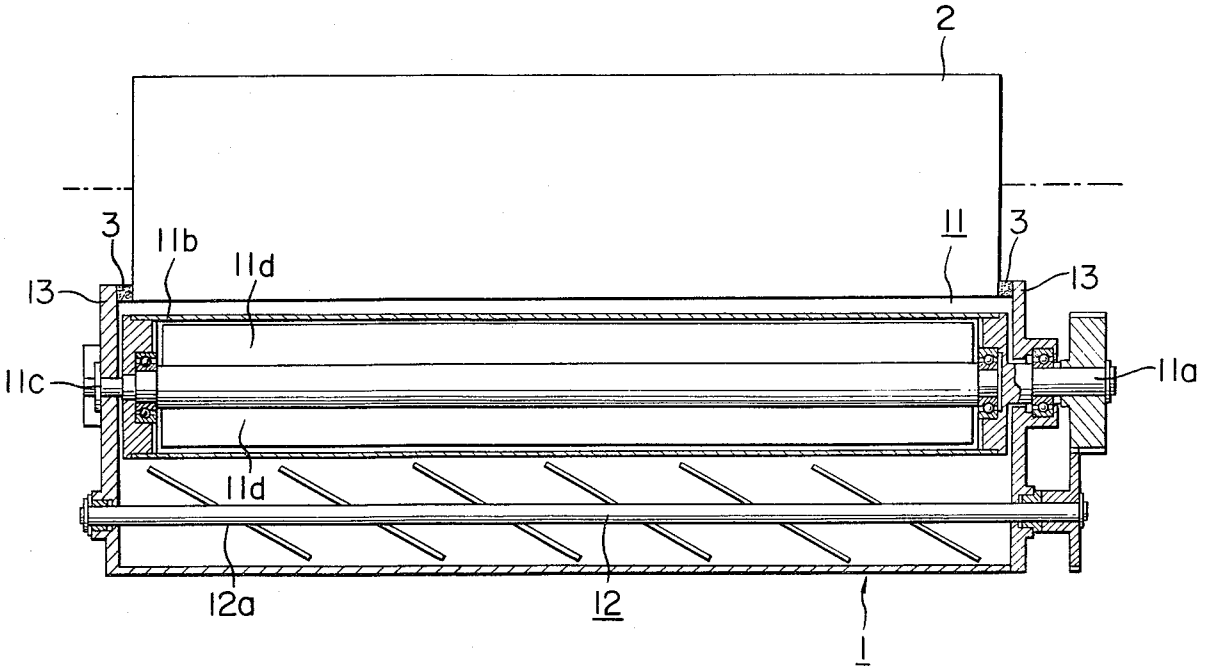
FIG. 1 and FIG. 2 are side views showing examples of the present invention respectively.

1 represents the developing device and 2 represents the photosensitive drum. The developing device 1 has the magnetic brush device 11 and the stirring blade device 12 therein and the magnetic brush device 11 is comprised the developing sleeve **11*b* that rotates together with the rotating axle 11*a* and plural pieces of magnet 11*d* supported inside the developing sleeve 11*b* by the fixed axle 11*c* and rotating axle 11*a* of the magnetic brush device 11 and the rotating axle 12*a* of the stirring blade device 12 is connected through gears to rotate being coupled with the rotation of the photosensitive drum 2. The side walls 13 that support brush device 11 and the axle of the stirring blade device 12 in this developing device 1 are extended to the end face side of the photosensitive drum 2. And in the example FIG. 1, the sealing members made of elastic material such as foamed rubber or felt that directly contact the end face of cross at right angle against axis of the photosensitive drum 2 and fill the clearance is attached on the extended portion. In the example of FIG. 2, on the other hand, the sealing members 3 made of elastic material such as foamed rubber or felt etc. are attached on the extended portions of the side walls so that they contact the end faces of supplementary members 4 provided supplementally on the both sides of the photosensitive substance drum 2 and indirectly fill the clearance between side walls 13 of the developing device 1 and the photosensitive drum 2**.

Figure 2:
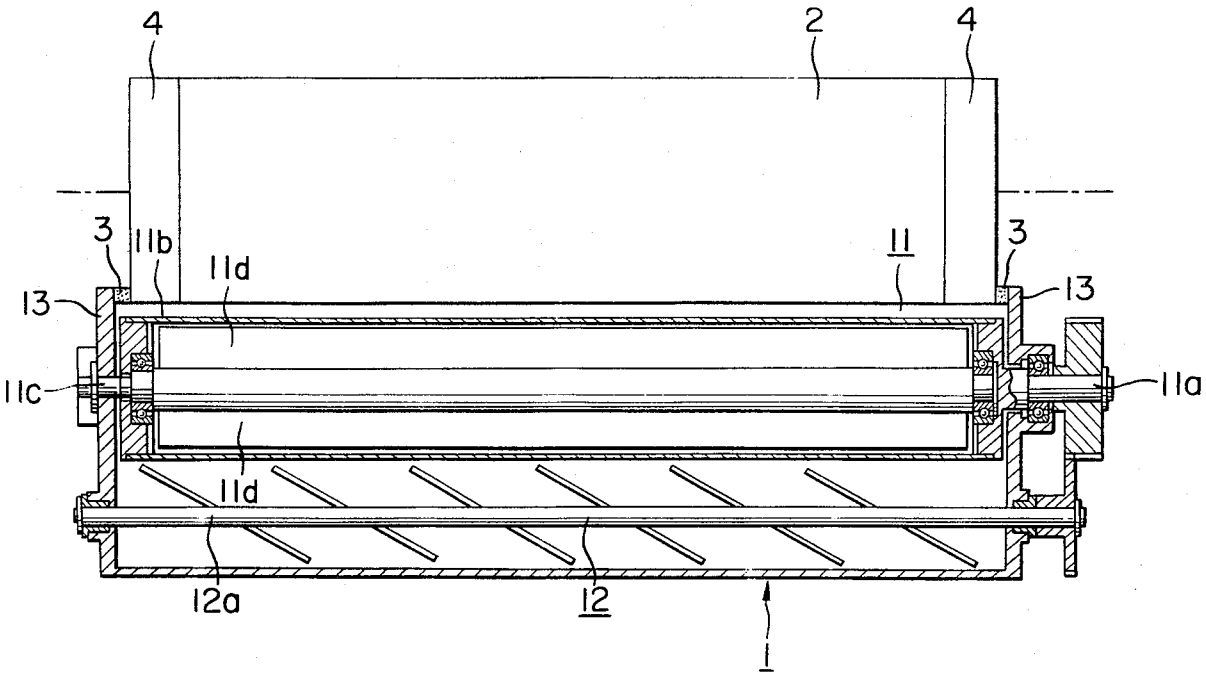

With the device to fill the clearance between the side walls 13 of the developing device 1 and the photosensitive drum 2 on the gap between the end faces of the photosensitive drum 2 and side walls like this, excellent effects such as that no unstableness exists in the clearance between the photosensitive drum 2 and the developing sleeve **11*b* even if the sealing members 3 are arranged to be firmly compressed, the scattering of the developer is perfectly prevented, there is no fear of damage on the photosensitive substance, entire width of the circumferential surface of the photosensitive drum 2 can be utilized as a photosensitive surface and, in the example shown in FIG. 1**, the apparatus will not be of big size, are obtained.

Incidentally, the present invention can naturally be applied even to the cleaning device besides the developing device and it is preferable that the sealing member is provided on the side of the side wall of the developing device etc. and it may also be provided on the end face at the photosensitive substance drum side.

What is claimed is:

1. A copying machine for an electrophotography, which comprises;

a photosensitive drum, a developing device comprising side walls of said developing device, and a sealing member made of an elastic material being equipped between said side walls and the end face of the side of said photosensitive drum for filling the clearance between the both items.

2. A copying machine according to claim 1, wherein said end face is the end face of cross at right angle against axis of said photosensitive drum.

3. A copying machine according to claim 1, wherein said end face is the end face of supplementary member provided supplementary on the both sides of said photosensitive drum.

4. A copying machine according to claim 1, wherein said developing device comprises a developing sleeve and a plural pieces of magnet.

5. A copying machine according to claim 4, wherein said developing device further comprises a stirring blade device.

6. A copying machine according to claim 5, wherein said developing sleeve, said magnets and said stirring blade device is supported by the side walls.

* * * * *